US009984865B2

(12) United States Patent
Asai et al.

(10) Patent No.: US 9,984,865 B2
(45) Date of Patent: May 29, 2018

(54) LIGHT-EMITTING SEALED BODY

(71) Applicant: HAMAMATSU PHOTONICS K.K., Hamamatsu-shi, Shizuoka (JP)

(72) Inventors: Akinori Asai, Hamamatsu (JP); Naoya Matsumoto, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 3 days.

(21) Appl. No.: 15/025,928

(22) PCT Filed: Oct. 29, 2014

(86) PCT No.: PCT/JP2014/078761

§ 371 (c)(1),
(2) Date: Mar. 30, 2016

(87) PCT Pub. No.: WO2015/083463

PCT Pub. Date: Jun. 11, 2015

(65) Prior Publication Data

US 2016/0240365 A1 Aug. 18, 2016

(30) Foreign Application Priority Data

Dec. 6, 2013 (JP) ..... 2013-253260

(51) Int. Cl.
*H01J 1/94* (2006.01)
*H01J 61/073* (2006.01)
(Continued)

(52) U.S. Cl.
CPC ..... *H01J 61/0737* (2013.01); *H01J 1/94* (2013.01); *H01J 65/04* (2013.01); *H01J 61/0732* (2013.01); *H01J 61/16* (2013.01)

(58) Field of Classification Search
CPC ..... H01J 1/94; H01J 65/04
(Continued)

(56) References Cited

U.S. PATENT DOCUMENTS 4,152,625 A 5/1979 Conrad
8,182,127 B2 5/2012 Yasuda et al.
(Continued)

FOREIGN PATENT DOCUMENTS

FR 2554302 A1 5/1985
JP S61-193358 A 8/1986
(Continued)

OTHER PUBLICATIONS

International Preliminary Report on Patentability dated Jun. 16, 2016 for PCT/JP2014/078761.
(Continued)

*Primary Examiner* — Christopher Raabe
(74) *Attorney, Agent, or Firm* — Drinker Biddle & Reath LLP

(57) ABSTRACT

In a light-emitting sealed body, a metal structure (electron emission structure) containing an easily electron-emitting material is used, so that it is not necessary to perform feeding for discharge between electrodes. Therefore, a feeding member does not need to be connected to the metal structure from the outside of a bulb. In addition, in the light-emitting sealed body, the metal structure is disposed in an internal space S of the bulb and a positioning unit of the metal structure is disposed only in the bulb. Therefore, in the light-emitting sealed body, the metal structure and the positioning unit do not penetrate the bulb and are not buried in the bulb and weakened portions are not formed in the bulb made of glass. Therefore, a sealing state of the bulb can be maintained surely.

15 Claims, 7 Drawing Sheets

(51) Int. Cl.
*H01J 65/04* (2006.01)
*H01J 61/16* (2006.01)

(58) Field of Classification Search
USPC ..... 313/538
See application file for complete search history.

(56) References Cited

U.S. PATENT DOCUMENTS

| | | | | |
|---|---|---|---|---|
| 9,099,292 | B1 | 8/2015 | Bezel et al. | |
| 9,646,816 | B2 * | 5/2017 | Asai | H01J 65/04 |
| 2007/0228288 | A1 | 10/2007 | Smith | |
| 2010/0165656 | A1 * | 7/2010 | Yasuda | G03F 7/70016 362/553 |
| 2010/0264820 | A1 | 10/2010 | Sumitomo et al. | |
| 2011/0181191 | A1 | 7/2011 | Smith et al. | |
| 2015/0034838 | A1 * | 2/2015 | Bezel | H01J 65/04 250/432 R |
| 2016/0240365 | A1 | 8/2016 | Asai et al. | |
| 2016/0336167 | A1 * | 11/2016 | Blondia | H01J 61/025 |

FOREIGN PATENT DOCUMENTS

| | | | |
|---|---|---|---|
| JP | H04-144053 | A | 5/1992 |
| JP | H06-243845 | A | 9/1994 |
| JP | H08-299951 | A | 11/1996 |
| JP | 2001-202924 | | 7/2001 |
| JP | 2006-010675 | A | 1/2006 |
| JP | 2009-532829 | A | 1/2006 |
| JP | 2011-119200 | A | 6/2011 |
| JP | 2013-519211 | A | 5/2013 |
| JP | 6023355 | | 11/2016 |

OTHER PUBLICATIONS

C. Carlhoff et al., "Continuous Optical Discharges at Very High Pressure", North-Holland Publishing Company, Jun. 13, 1980, p. 439-p. 447.

Leon J. Radziemski et al., "Laser-Induced Plasmas and Applications", Marcel Dekker, 1989, p. 169-p. 206.

* cited by examiner

LIGHT-EMITTING SEALED BODY

TECHNICAL FIELD

The present invention relates to a light-emitting sealed body that is filled with light emission gas.

BACKGROUND ART

Conventionally, light source devices that radiate a laser light to ionized gas in a casing, maintain a plasma state, and generate ultraviolet rays are known. For example, in a light source described in Patent Literature 1, feeding is performed between counter electrodes disposed in a casing made of glass to generate plasma by discharge between the electrodes. The laser light is continuously radiated to the plasma, so that a laser support light to be a plasma emission is put on/maintained.

CITATION LIST

Patent Literature

Patent Literature 1: Japanese Patent Application National Publication (Laid-Open) No. 2009-532829

SUMMARY OF INVENTION

Technical Problem

In the light source device according to the related art described above, because the feeding needs to be performed between the counter electrodes, it is necessary to configure the electrodes (or feeding paths to the electrodes) to penetrate the casing. However, if penetration portions of the electrodes (or the feeding paths to the electrodes) or portions fusion-bonded to bury the electrodes (or the feeding paths to the electrodes) in the casing to hold the electrodes (or the feeding paths to the electrodes) exist, bonding portions of the casing and the electrodes (or the feeding paths to the electrodes) become weakened portions due to a difference of thermal expansion coefficients and a sealing state of the casing may not be maintained.

The present invention has been made to resolve the above problem and an object of the present invention is to provide a light-emitting sealed body that can maintain a sealing state of a casing surely.

Solution to Problem

In order to resolve the above problem, a light-emitting sealed body according to the present invention includes: a casing of which an internal space is filled with light emission gas; an electron emission structure that comprises an easily electron-emitting material emitting electrons by radiation of a laser light; and a positioning unit that positions the electron emission structure in the internal space, wherein the electron emission structure is disposed only in the internal space of the casing, and the positioning unit is disposed only in the internal space of the casing or at the outside of the casing.

In the light-emitting sealed body, the electron emission structure is disposed only in the internal space of the casing filled with the light emission gas and the positioning unit of the electron emission structure is also disposed only in the internal space of the casing or at the outside of the casing. That is, in the light-emitting sealed body, the electron emission structure and the positioning unit do not penetrate the casing and parts thereof are not buried in the casing. Therefore, weakened portions can be prevented from being generated in the casing and a sealing state of the casing can be maintained surely.

In addition, preferably, the electron emission structure has an electron emission unit that is made of a metal member containing the easily electron-emitting material and a support unit that supports the electron emission unit and the support unit is positioned in the internal space by the positioning unit, so that the electron emission structure is positioned in the internal space. In this case, the electron emission unit is easily disposed at a desired position, in a state in which a sealing state of the casing is maintained surely.

In addition, preferably, the casing has a body portion where the electron emission unit is positioned and a protrusion portion that protrudes from the body portion and the support unit is positioned in the protrusion portion by the positioning unit. In this case, the support unit (electron emission structure) can be positioned optimally without affecting the body portion.

In addition, a small diameter portion obtained by reducing an inner diameter of the protrusion portion to contact the support unit is preferably formed as the positioning unit. In this case, the support unit (electron emission structure) can be held surely by the small diameter portion.

In addition, preferably, a spacer member is provided as the positioning unit between the support unit and an inner wall of the protrusion portion and the support unit is fitted into the internal space of the protrusion portion by the spacer member. In this case, the support unit (electron emission structure) can be held surely by the spacer member.

In addition, preferably, an elastic member is provided as the positioning unit between the support unit and an inner wall of the protrusion portion and the support unit is fitted into the internal space of the protrusion portion by the elastic member. In this case, the support unit (electron emission structure) can be held surely by the elastic member.

In addition, preferably, at least a part of the support unit is formed of a metal and a small diameter portion obtained by reducing an inner diameter of the protrusion portion, a large diameter portion provided in the support unit to contact the small diameter portion, and a magnetic force application unit applying magnetic force to the support unit from the outside of the casing such that the large diameter portion contacts the small diameter portion are formed as the positioning unit. In this case, the support unit (electron emission structure) can be held surely by the magnetic force application unit.

In addition, preferably, at least a part of the support unit is formed of a metal and a spacer member provided between the support unit and an inner wall of the protrusion portion such that the support unit is inserted, a large diameter portion provided in the support unit to contact the spacer member, and a magnetic force application unit applying magnetic force to the support unit from the outside of the casing such that the large diameter portion contacts the spacer member are formed as the positioning unit. In this case, the support unit (electron emission structure) can be held surely by the magnetic force application unit.

In addition, preferably, the support unit is made of a rod-shaped member and the rod-shaped member has a minute diameter portion that supports the electron emission unit and has a diameter smaller than a diameter of the body portion. In this way, when the laser light is radiated to the electron emission unit, heat is unlikely to be transmitted to the support unit and the electron emission unit can be efficiently heated. Therefore, efficient electron emission can be realized.

In addition, preferably, the support unit is made of a rod-shaped member and the rod-shaped member has a minute diameter portion that has a diameter smaller than a diameter of the body portion and a relay portion that is supported to the minute diameter portion, is thicker than the minute diameter portion, and supports the electron emission unit. In this case, the relay portion supported by the minute diameter portion is heated by radiation of the laser light, so that the electron emission unit can be heated efficiently while sputtering in the electron emission unit is suppressed. Therefore, efficient electron emission can be realized.

In addition, the electron emission unit preferably has an inclined surface that is inclined to an incidence axis of the laser light. In this way, a discharge direction of sputtered materials generated by the electron emission unit by radiation of the laser light can be shifted from an incidence direction of the laser light and the sputtered materials can be suppressed from obstructing incidence of the laser light.

In addition, preferably, the electron emission structure has a spherical shape and the positioning unit has a magnetic film that is made of a ferromagnetic material and covers at least a part of the electron emission structure and a magnet that is disposed to face the casing at the outside of the casing. In this case, the electron emission structure can be held surely by magnetic force with the casing therebetween and a sealing state of the casing can be maintained surely.

In addition, preferably, the electron emission structure has a spherical shape and the positioning unit has a first seat which is disposed in the casing and into which a part of the electron emission structure is fitted. In this case, the electron emission structure can be positioned by the first seat with a simple configuration.

In addition, preferably, both the casing and the electron emission structure have a spherical shape and the positioning unit has a second base which is disposed at the outside of the casing and into which a part of the casing is fitted. In this case, the casing is positioned by the second base, so that the electron emission structure can also be positioned in the casing.

In addition, preferably, both the casing and the electron emission structure have a cylindrical shape and a small diameter portion obtained by reducing an inner diameter of the casing to contact the electron emission structure is formed as the positioning unit. In this case, an aberration of the laser light can be suppressed by causing the laser light to be incident from an end face of an axial direction of the casing having the cylindrical shape. In addition, the electron emission structure can be held surely by the small diameter portion.

Advantageous Effects of Invention

According to the light-emitting sealed body according to the present invention, a sealing state of a casing can be maintained surely.

DESCRIPTION OF EMBODIMENTS

Hereinafter, preferred embodiments of a light-emitting sealed body according to the present invention will be described in detail with reference to the drawings.

[First Embodiment]

Figure 1:
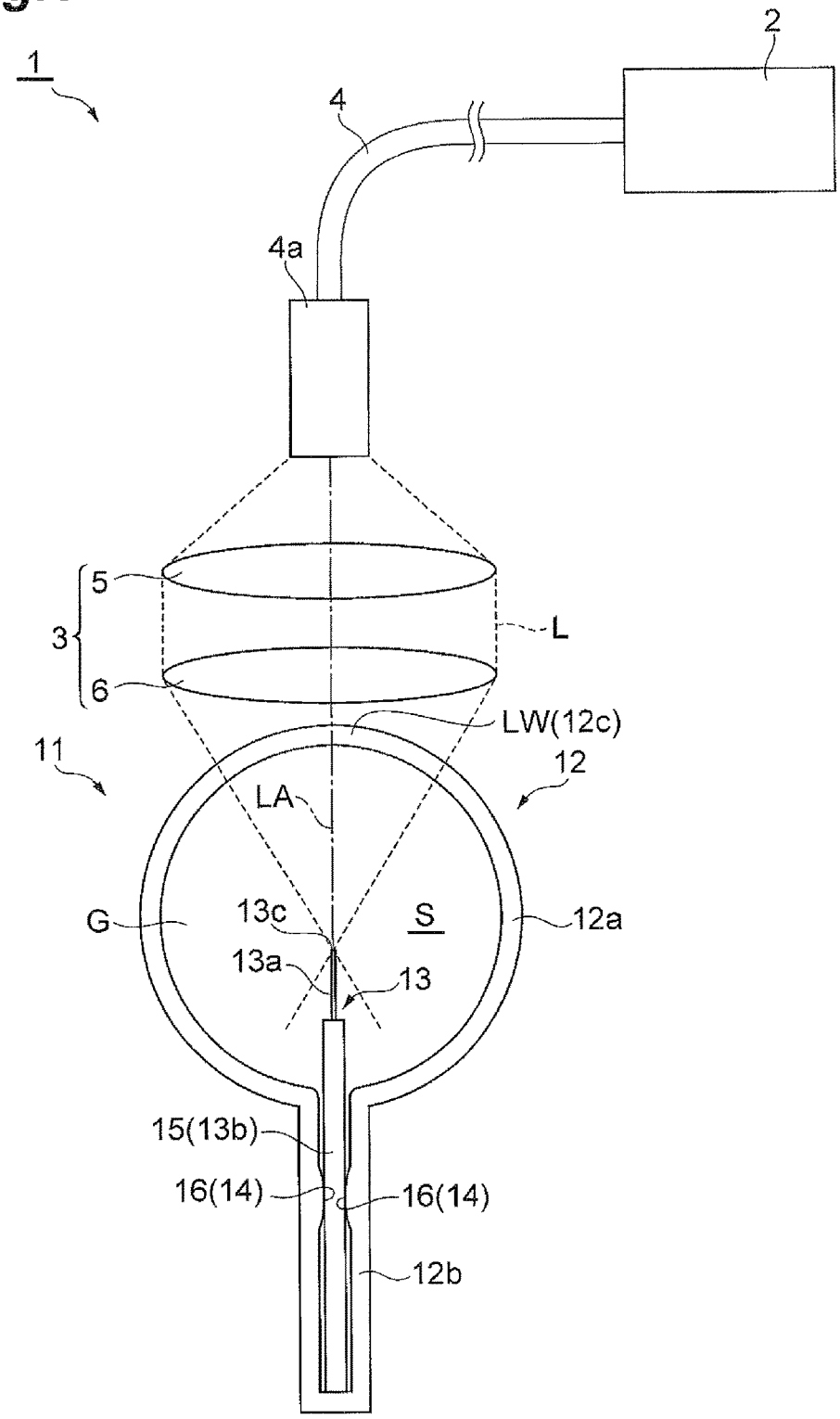
FIG. 1 is a schematic diagram illustrating a light source device configured by applying a light-emitting sealed body according to a first embodiment of the present invention.

FIG. 1 is a schematic diagram illustrating a light source device configured by applying a light-emitting sealed body according to a first embodiment of the present invention. As illustrated in the same drawing, a light source device 1 includes a laser unit 2 that generates a laser light, an optical system 3 that guides the laser light L from the laser unit 2, and a light-emitting sealed body 11 that stores a metal structure (electron emission structure) 13 containing an easily electron-emitting material emitting electrons by radiation of the laser light L and light emission gas G. In the light source device 1, if the continuous laser light L is radiated to the metal structure 13, plasma by the light emission gas G is generated in a radiation region of the continuous laser light L in the vicinity of the metal structure 13. In addition, it is assumed that the plasma is generated when electrons emitted from the metal structure 13 by radiation of the continuous laser light L ionize the light emission gas G and the continuous laser light L is radiated to the ionized light emission gas G. In addition, the continuous laser light L is continuously radiated to the generated plasma (laser energy is continuously supplied to the plasma), so that a laser support light of a high brightness to be a plasma emission having a predetermined light emission region including a condensing position F of the continuous laser light L can be put on/maintained in the light-emitting sealed body 11 to be a light source 7. The laser support light is used as a light source for semiconductor inspection or a light for spectroscopic measurement, for example.

The laser unit 2 is a laser diode, for example. The laser unit 2 may be any one of a continuous laser and a pulsed laser. However, in this embodiment, the continuous laser is used. The laser light L having a wavelength according to an absorption spectrum of the light emission gas G, for example, a wavelength of 980 nm is emitted as continuous waves from the laser unit 2. An output of the laser light L is about 60 W, for example. The laser light L emitted from the laser unit 2 is guided to the optical system 3 by an optical fiber 4. The optical system 3 is an optical system that condenses the laser light L from the laser unit 2 toward the light-emitting sealed body 11. The optical system 3 is configured by two lenses 5 and 6, for example. After the laser light L emitted from a head 4*a* of the optical fiber 4 becomes parallel light by the lens 5, the laser light L is condensed toward the light-emitting sealed body 11 with an optical axis LA by the lens 6.

More specifically, the light-emitting sealed body 11 is configured by a bulb (casing) 12 of which an internal space S is filled with the light emission gas G at a high pressure, the metal structure 13 containing the easily electron-emitting material emitting the electrons by radiation of the laser light L, and a positioning unit 14 that positions the metal structure 13 in the internal space S.

The bulb 12 is formed hollowly using glass, for example, and has a spherical portion (body portion) 12*a* having the metal structure 13 positioned therein and having a spherical outer shape and the spherical internal space S and a protrusion portion 12*b* protruding from a part of the spherical portion 12*a* cylindrically. The internal space S of the bulb 12 is filled with the light emission gas G, for example, xenon gas, at a high pressure. In this embodiment, a top portion 12*c* of the spherical portion 12*a* positioned at the side opposite to the protrusion portion 12*b* corresponds to an incidence portion (laser incidence window portion LW) of the laser light L. The laser incidence window portion LW is not limited to the top portion 12*c* and may be any portion of the spherical portion 12*a* that faces a desired laser incidence portion.

The metal structure 13 is formed of a metal having a high melting point such as tungsten and has an electron emission unit 13*a* containing barium as the easily electron-emitting material and a support unit 13*b* supporting the electron emission unit 13*a*. As illustrated in FIG. 1, the electron emission unit 13*a* to which the laser light L is radiated is formed in a shape of a cylinder having a small diameter and is disposed in the spherical portion 12*a* in a state in which a leading end 13*c* becoming an incidence portion of the laser light L is disposed toward the top portion 12*c* (laser incidence window portion LW) of the bulb 12. The incidence portion of the continuous laser light L is not limited to the leading end 13*c* and may be a side portion of the electron emission unit 13*a*.

Meanwhile, the support unit 13*b* has a rod-shaped member 15 that is formed cylindrically using a metal having a high melting point such as molybdenum. The electron emission unit 13*a* (leading end 13*c*) is supported to a leading end side of the support unit 13*b* to be disposed at a desired position of the internal space S in the spherical portion 12*a* and a base end side of the support unit 13*b* is disposed in the internal space S in the protrusion portion 12*b*. Materials configuring the electron emission unit 13*a* and the support unit 13*b* do not need to be changed and the support unit 13*b* may be formed integrally using a material used for the electron emission unit 13*a*. In addition, a base may be formed integrally using the same metal and the easily electron-emitting material may be contained in only a portion corresponding to the electron emission unit 13*a*. In addition, the electron emission unit 13*a* or the metal structure 13 may be formed of the easily electron-emitting material. The base of the electron emission structure is not limited to the metal (conductive material) such as tungsten and molybdenum and may be an insulating material such as ceramic.

The light-emitting sealed body 11 has a small diameter portion 16 to hold the rod-shaped member 15 to be the support unit 13*b*, as the positioning unit 14 of the metal structure 13 in the internal space S of the bulb 12. The small diameter portion 16 is provided using a part of an inner wall of the protrusion portion 12*b* and an inner diameter of the protrusion portion 12*b* is reduced to be smaller than an inner diameter of the other portion, such that the small diameter portion 16 contacts the rod-shaped member 15. The small diameter portion 16 contacts only a circumferential surface of the rod-shaped member 15 and is not fusion-bonded to the rod-shaped member 15. In addition, the small diameter portion 16 may be provided to be closer to a base end side (lower side of the drawings) than a position exemplified in FIG. 1 and may be provided to be closer to a leading end side (upper side of the drawings). In addition, multiple small diameter portions 16 may be provided.

As described above, in the light-emitting sealed body 11, the metal structure 13 containing the easily electron-emitting material is stored in the bulb 12 filled with the light emission gas G. By using the metal structure 13, in the light-emitting sealed body 11, the plasma is generated by radiating the laser light L to the metal structure 13 and the laser light L is continuously radiated to the plasma, so that the laser support light of the high brightness can be put on/maintained. When the plasma emission is extracted from the light-emitting sealed body 11, the plasma emission is preferably extracted from a direction intersecting with the optical axis LA of the laser light L and is more preferably extracted from a direction orthogonal to the optical axis LA.

In the light-emitting sealed body 11, the metal structure 13 containing the easily electron-emitting material emitting the electrons by radiation of the laser light L is used, so that it is not necessary to perform feeding between counter electrodes to generate arc discharge as in the related art. That is, in the light-emitting sealed body 11, a feeding member does not need to be connected to the metal structure 13 from the outside of the bulb 12. That is, because the metal structure 13 has a configuration different from a configuration of the electrodes in which the feeding is necessary, it can be said that there is no electrode in the light-emitting sealed body 11. In addition, in the light-emitting sealed body 11, an entire portion of the metal structure 13 is disposed in the internal space S of the bulb 12 and the positioning unit 14 (small diameter portion 16) of the metal structure 13 is configured by a part of the bulb 12. Therefore, in the light-emitting sealed body 11, the metal structure 13 and the positioning unit 14 do not penetrate the bulb 12 and parts thereof are not buried in the bulb and weakened portions are not formed in the bulb 12 made of the glass. Therefore, a sealing state of the bulb 12 can be maintained surely. Because the sealing state of the bulb 12 can be maintained surely, a life can be suppressed from being shortened due to damage of the bulb 12 or leakage of the light emission gas G and because a sealing pressure of the light emission gas G can be increased, a brightness of the light source device 1 can be improved.

In addition, in the light-emitting sealed body 11, the electron emission unit 13*a* is supported to the leading end side of the rod-shaped member 15 (support unit 13*b*) and the bulb 12 has the spherical portion 12*a* in which the leading end side of the rod-shaped member 15 and the electron emission unit 13*a* are positioned and the protrusion portion 12*b* which protrudes from the spherical portion 12*a* and in which the base end side of the rod-shaped member 15 is stored to configure the positioning unit 14 (small diameter portion 16). As a result, the electron emission unit 13*a* is easily disposed at the desired position in the internal space S in the spherical portion 12*a* while the sealing state of the bulb 12 is maintained surely.

In addition, in the light-emitting sealed body 11, the diameter of the electron emission unit 13*a* is reduced sufficiently as compared with the diameter of the rod-shaped member 15 (support unit 13*b*). As a result, because a time in which the electron emission unit 13*a* is heated by the laser light L to easily emit the electrons can be shortened, a time until the laser support light is put on can be shortened and occurrence of sputtering of the metal structure 13 can be reduced. In the light-emitting sealed body of a system using the arc discharge between the counter electrodes, it is necessary to put a high value on heat radiation of the electrodes to suppress the damage of the electrodes by the heat generated by the arc discharge. For this reason, electrodes having a constant thickness or more are necessary. However, in a metal excitation system such as the light-emitting sealed body 11, because the arc discharge is not used, it is not necessary to put a high value on the heat radiation of the electron emission unit 13*a*. Therefore, the diameter of the electron emission unit 13*a* can be sufficiently reduced. In addition, because a total amount of impregnation materials containing the easily electron-emitting material existing in the bulb 12 can be reduced, adhesion of contaminated materials to the inner wall of the bulb 12 due to the impregnation materials can be suppressed.

Figure 2:
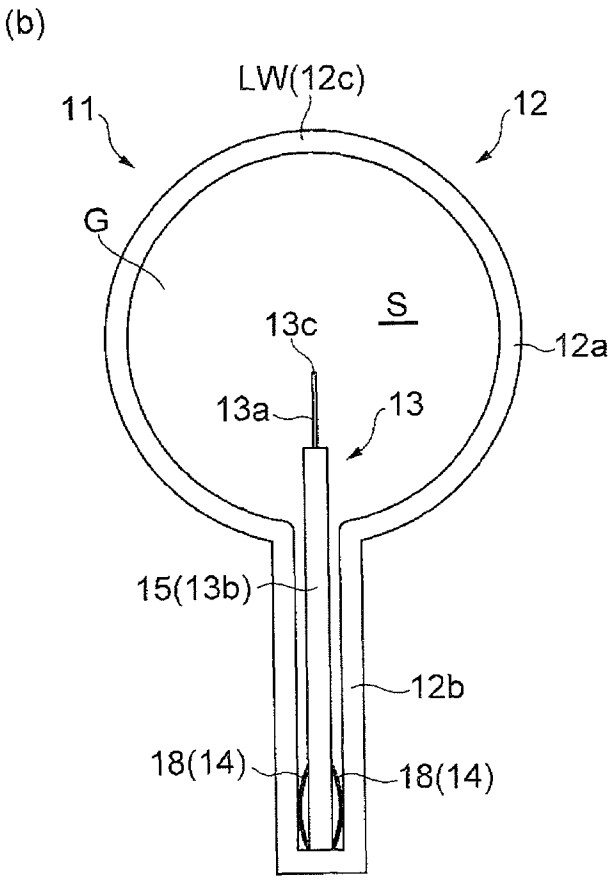
FIG. 2 is a diagram illustrating another configuration example of a positioning unit of a metal structure and (a) illustrates a form using a spacer member and (b) illustrates a form using a plate spring member.
Figure 2:
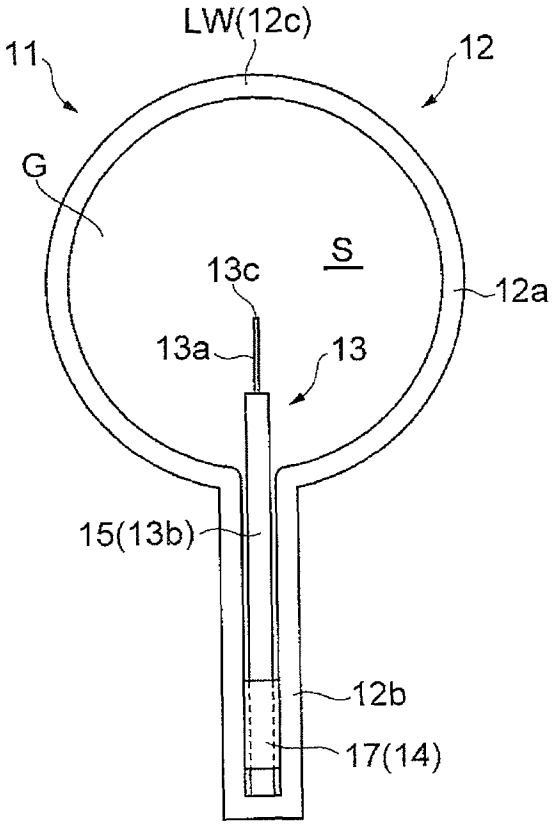

The configuration of the positioning unit 14 can adopt another aspect. For example, as illustrated in FIG. 2(*a*), a spacer member 17 that includes a through-hole having an inner diameter nearly matched with an outer diameter of the rod-shaped member 15 in a cylindrical member having an outer diameter nearly matched with an inner diameter of the protrusion portion 12*b* in the bulb 12 may be used as the positioning unit 14. In this case, the base end side of the rod-shaped member 15 may be fitted into the internal space S of the protrusion portion 12*b* by the spacer member 17 by fitting the rod-shaped member 15 into the through-hole of the spacer member 17 and fitting the spacer member 17 into the internal space S of the protrusion portion 12*b*, using the spacer member 17.

For example, as illustrated in FIG. 2(*b*), plate spring members (elastic members) 18 that are curved outward may be used as the positioning unit 14. In this case, the base end side of the rod-shaped member 15 may be fitted into the internal space S of the protrusion portion 12*b* by the plate spring members 18 by providing the plate spring members 18 at the based end side of the rod-shaped member 15 and contacting the plate spring members 18 with the inner wall of the protrusion portion 12*b* elastically. In these configurations, the positioned metal structure 13 can be held surely by each of the spacer member 17 and the plate spring members 18.

A material configuring the spacer member 17 is preferably the same material as the bulb 12 (protrusion portion 12*b*). However, other materials having a similar thermal expansion coefficient may be used. If the material configuring the spacer member 17 is the same material as the bulb 12 (protrusion portion 12*b*) or the material having the similar thermal expansion coefficient, the spacer member 17 may be fixed by fusion-bonding an external surface of the spacer member 17 and a surface of the inner wall of the protrusion portion 12*b*.

The positioning unit is not limited to the plate spring members 18 curved outward and fitting of the rod-shaped member 15 may be performed by arranging plate spring members curved inward in the internal space S of the protrusion portion 12*b* and inserting the rod-shaped member 15 between the plate spring members. The positioning unit is not limited to the plate spring members and if the rod-shaped member 15 and the inner wall of the protrusion portion 12*b* can be fitted by elasticity, other elastic members may be used. Even in any positioning unit 14, the fitting portion of the rod-shaped member 15 and the protrusion portion 12*b* is not limited to the base end side (lower side of the drawings) and may be at the leading end side (upper side of the drawings). In addition, multiple positioning units 14 may be provided.

Figure 3:
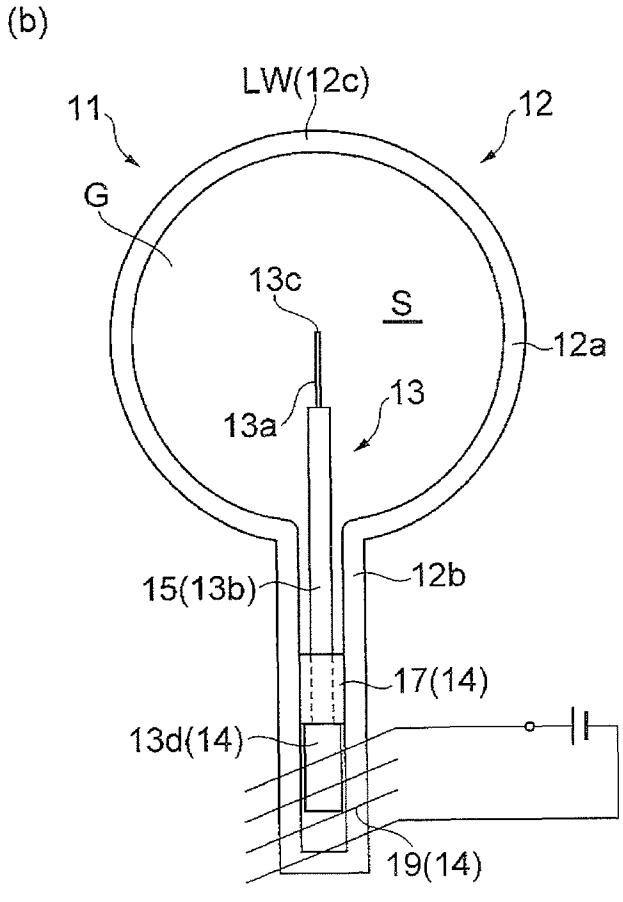
FIG. 3 is a diagram illustrating another configuration example of a positioning unit of a metal structure and (a) illustrates a form using a coil and a small diameter portion and (b) illustrates a form using a coil and a spacer member.
Figure 3:
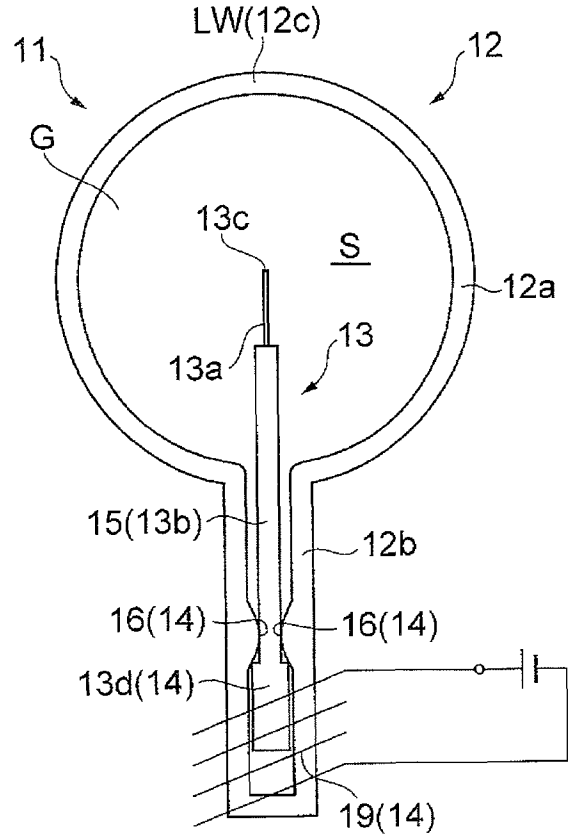

As a different form of the positioning unit 14, for example, as illustrated in FIG. 3(*a*), the metal structure 13 may be configured to be movable in an axial direction of the metal structure 13 in the internal space S and a coil (magnetic force application unit) 19 may be used as the positioning unit 14. In this form, a small diameter portion 16 that is obtained by reducing the diameter of the inner wall of the protrusion portion 12*b* and holds the rod-shaped member 15 to be the support unit 13*b* to slide in the axial direction of the metal structure 13 (rod-shaped member 15) and a large diameter portion 13*d* that is provided in an end portion of the rod-shaped member 15, has a diameter larger than a diameter of a portion communicating with the small diameter portion 16, and is provided to contact the small diameter portion 16 are provided as the positioning unit 14.

That is, in this form, the support unit 13*b* is configured by the rod-shaped member 15 and the large diameter portion 13*d*. In addition, the coil 19 is provided at an outer wall side of the protrusion portion 12*b* to correspond to a position of the large diameter portion 13*d* and applies the magnetic force to move the metal structure 13 in the axial direction thereof to the support unit 13*b* made of a magnetic material. Specifically, the coil 19 applies the magnetic force to the support unit 13*b* and applies force to move the metal structure 13 to the side of the electron emission unit 13*a* (side of the spherical portion 12*a*). Meanwhile, the large diameter portion 13*d* contacts the small diameter portion 16 and restricts the movement thereof. That is, the coil 19, the small diameter portion 16, and the large diameter portion 13*d* cooperate with each other, so that the movable metal structure 13 can be disposed at the predetermined position.

When the coil (magnetic force application unit) 19 is used as the positioning unit 14, for example, as illustrated in FIG. 3(*b*), the spacer member 17 that is fitted into the inner wall of the protrusion portion 12*b* such that the rod-shaped member 15 is inserted to slide in the axial direction of the metal structure 13 (rod-shaped member 15) and the large diameter portion 13*d* that is provided in the end portion of the rod-shaped member 15, has the diameter larger than the diameter of the portion communicating with the spacer member 7, and is provided to contact the spacer member 17 may be provided as the positioning unit 14.

Even in this case; the coil 19 is provided at an outer wall side of the protrusion portion 12*b* to correspond to a position of the large diameter portion 13*d* and applies the magnetic force to move the metal structure 13 in the axial direction thereof to the support unit 13*b* made of the magnetic material. Specifically, the coil 19 applies the magnetic force to the support unit 13*b* and applies the force to move the metal structure 13 to the side of the electron emission unit 13*a* (side of the spherical portion 12*a*). Meanwhile, the large diameter portion 13*d* contacts the spacer member 17 and restricts the movement thereof. That is, the coil 19, the spacer member 17, and the large diameter portion 13*d* cooperate with each other, so that the movable metal structure 13 can be disposed at the predetermined position.

The large diameter portion 13*d* may have a material equal to the material of the rod-shaped member 15 and may have a material different from the material of the rod-shaped member 15. For example, when the large diameter portion 13*d* is formed of a non-magnetic material, the rod-shaped member 15 receives the magnetic force from the coil 19 and contributes to positioning of the metal structure 13 and the opposite case is also enabled. However, at least one of the large diameter portion 13*d* and the rod-shaped member 15 is made of a magnetic material. In addition, in the above configuration, after the laser support light is put on, a switch of the coil 19 may be turned off, the application of the magnetic force may be stopped, and the metal structure 13 may be moved to the side of the large diameter portion 13*d* (side of the protrusion portion 12*b*) to contact the large diameter portion 13*d* with the a bottom portion side of the protrusion portion 12*b*. In this case, the leading end 13*c* of the electron emission unit 13*a* is separated from a focal position of the laser light L, so that energy of the laser light L radiated to the electron emission unit 13*a* can be decreased. As a result, occurrence of sputtering of the metal structure 13 can be appropriately reduced. A feeding state of the coil 19 is not limited thereto and various states can be selected appropriately according to a difference such as the arrangement of the light-emitting sealed body 11.

Figure 4:
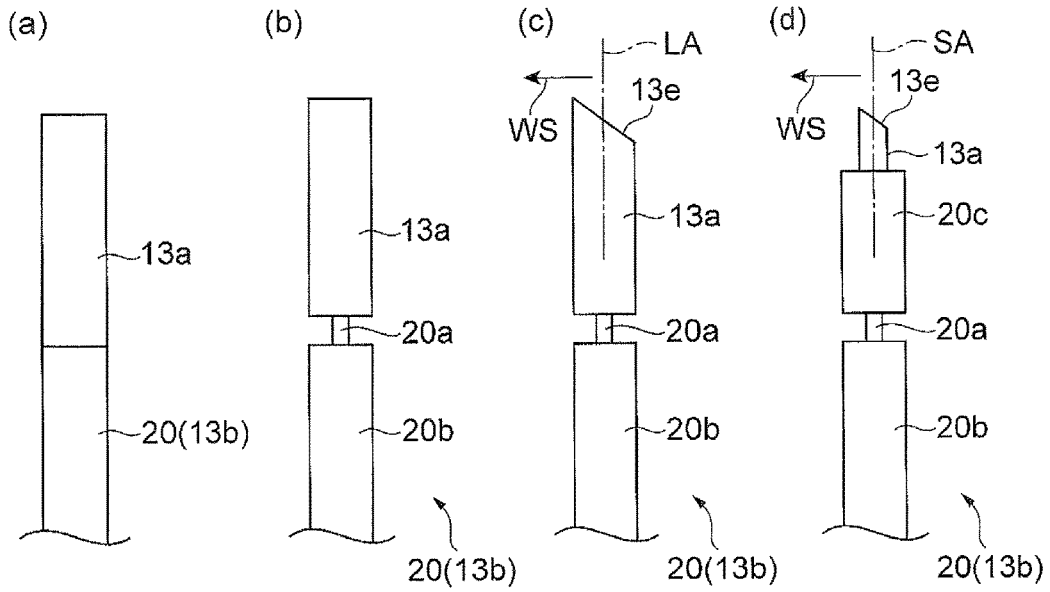
FIG. 4 is a diagram illustrating another configuration example of a metal structure and a rod-shaped member and (a) illustrates a form using a rod-shaped member having a diameter equal to a diameter of an electron emission unit, (b) illustrates a form in which a minute diameter portion is provided in a rod-shaped member, (c) illustrates a form using an electron emission unit having an inclined surface, and (d) illustrates a form in which a minute diameter portion and a relay portion are provided in a rod-shaped member.

In addition, the configuration of the metal structure 13 can adopt another aspect. In the form illustrated in FIG. 1, the rod-shaped member 15 having the diameter larger than the diameter of the electron emission unit 13*a* is exemplified as the support unit 13*b*. However, a rod-shaped member 20 having a diameter equal to the diameter of the electron emission unit 13*a* may be used as the support unit 13*b*, as illustrated in FIG. 4(*a*), for example. In addition, a minute diameter portion 20*a* that supports the electron emission unit 13*a* and has a diameter smaller than a diameter of a body portion 20*b* may be formed at a leading end side of the rod-shaped member 20, as illustrated in FIG. 4(*b*), for example. In this case, when the laser light L is radiated to the electron emission unit 13*a*, heat is unlikely to be transmitted to the rod-shaped member 20 (body portion 20*b*) and the electron emission unit 13*a* can be efficiently heated. Therefore, efficient electron emission can be realized.

In addition, an electron emission unit 13*a* having an inclined surface 13*e* inclined to the optical axis LA of the laser light L may be supported to the rod-shaped member 20, as illustrated in FIG. 4(*c*). An inclination angle of the inclined surface 13*e* can be arbitrarily set. In this case, a discharge direction of sputtered materials generated by the electron emission unit 13*a* by radiation of the laser light L can be shifted from an incidence direction of the laser light L and occurrence of a situation where the sputtered materials adhere to the inner wall side of the laser incidence window portion LW of the bulb 12 to obstruct incidence of the laser light L can be suppressed. In this configuration, an extraction direction of the laser support light from the bulb 12 is set to the side (for example, a side not facing the inclined surface 13*e*, as shown by an arrow WS of FIG. 4(*c*)) opposite to the discharge direction of the sputtered materials, so that an influence of sputtering on an extraction portion of the laser support light is reduced. This configuration is more preferable.

In addition, at the leading end side of the rod-shaped member 20, a relay portion 20*c* may be formed at a leading end side of the minute diameter portion 20*a* having the diameter smaller than the diameter of the body portion 20*b*, as illustrated in FIG. 4(*d*). The relay portion 20*c* is supported to the minute diameter portion 20*a*, is thicker than the minute diameter portion 20*a* and the electron emission unit 13*a*, and supports the electron emission unit 13*a* at the leading end side thereof. In this case, the electron emission unit 13*a* can be heated indirectly by causing the laser light L to be incident on the relay portion 20*c* from a direction intersecting with an axial line SA of the rod-shaped member 20 and heating the relay portion 20*c*. Then, the laser light L is radiated to the heated electron emission unit 13*a*, so that a laser support light of a high brightness can be put on efficiently. In this case, occurrence of sputtering in the electron emission unit 13*a* can be suppressed as compared with the case in which the laser light L is radiated directly to the electron emission unit 13*a* and the electron emission unit 13*a* is heated. In addition, the minute diameter portion 20*a* makes the heat of the relay portion 20*c* less transmittable to the body portion 20*b* and more transmittable to the electron emission unit 13*a*. Therefore, the electron emission unit 13*a* can be heated efficiently and efficient electron emission can be realized. In addition, the inclined surface 13*e* may not be provided.

[Second Embodiment]

Figure 5:
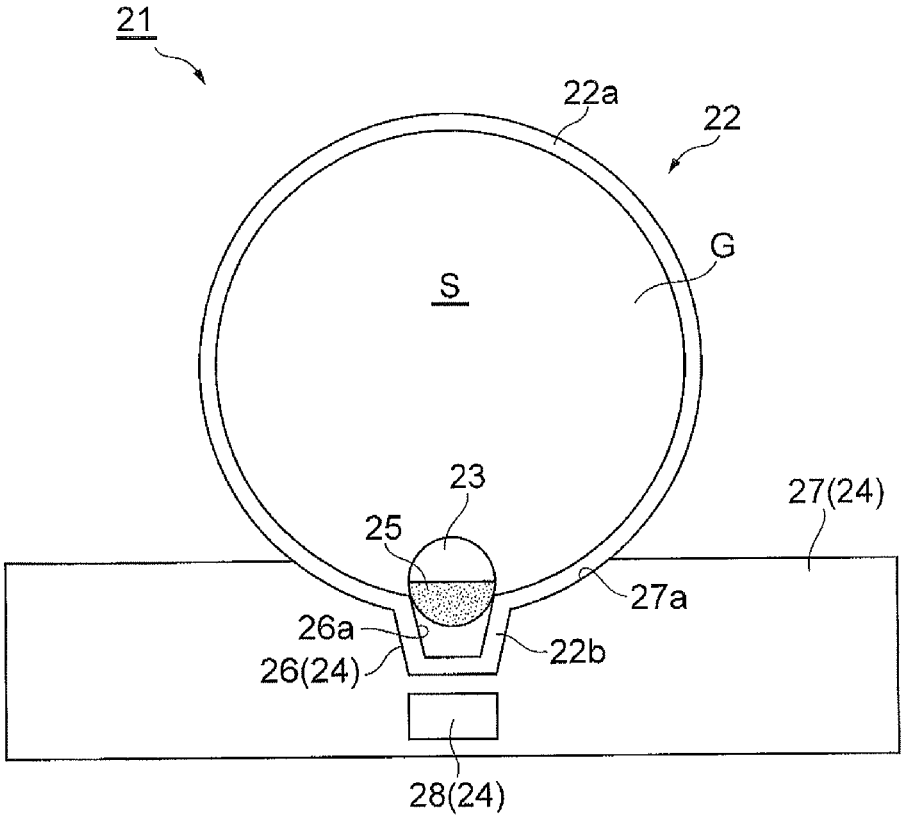
FIG. 5 is a diagram illustrating a light-emitting sealed body according to a second embodiment of the present invention.

FIG. 5 is a diagram illustrating a light-emitting sealed body according to a second embodiment of the present invention. As illustrated in the same drawing, in a light-emitting sealed body 21 according to the second embodiment, a shape of a bulb 22, a shape of a metal structure 23, and a configuration of a positioning unit 24 are different from those in the first embodiment.

More specifically, in the light-emitting sealed body 21, the bulb 22 corresponds to an approximately spherical casing that has a spherical portion 22*a* and a protrusion portion 22*b* protruding from a part of the spherical portion 22*a*. Also, the metal structure 23 that is disposed in an internal space S of the bulb 22 has a spherical shape. In addition, coating is performed on a surface of the metal structure 23 using a magnetic film made of a ferromagnetic material, such as a nickel film 25, to cover nearly a half of the surface of the metal structure 23. In a bottom portion of the internal space S of the bulb 22, a first base 26 having a fitting portion 26*a* into which a part (for example, a portion coated with the nickel film 25) of the metal structure 23 is fitted is disposed as a positioning unit 24. More specifically, the first base 26 has the fitting portion 26*a* to be a recessed portion formed in an inner wall of the protrusion portion 22*b*. A structure after sealing an exhaust pipe used to exhaust the bulb 22 and seal light emission gas G can be used as the protrusion portion 22*b* and the fitting portion 26*a*.

In addition, the positioning unit 24 has a second base 27 that has a fitting potion 27*a* into which the bottom portion of the bulb 22 is fitted. More specifically, the second base 27 is a member holding the bulb 22 from the outside and has the fitting portion 27*a* to be a recessed portion corresponding to the shapes of the bottom portion and the protrusion portion 22*b* of the bulb 22. As such, because the fitting portion 27*a* has the shape corresponding to the protrusion portion 22*b*, stability of the bulb 22 is further secured.

In addition, the positioning unit 24 has a magnet 28 that is buried in the second base 27 at a position facing the first base 26. More specifically, the magnet 28 is a region corresponding to the fitting portion 27*a* of the second base 27, is buried at a position where the magnetic force is exerted to the nickel film 25 of the metal structure 23 disposed in the first base 26, and functions as the positioning unit 24 in cooperation with the nickel film 25. That is, in the positioning unit 24, the nickel film 25 and the first base 26 are disposed only in the internal space S of the bulb 22 and the second base 27 and the magnet 28 are disposed only outside the bulb 22. Both the nickel film 25 and the first base 26 and the second base 27 and the magnet 28 do not penetrate the bulb 22 and parts thereof are not buried in the bulb 22.

Even in the light-emitting sealed body 21, the metal structure 23 and the positioning unit 24 do not penetrate the bulb 22 and the parts thereof are not buried in the bulb 22 and the weakened portions are not formed in the bulb 22 made of the glass. For this reason, a sealing state of the bulb 22 can be maintained surely. In the light-emitting sealed body 21, the metal structure 23 can be positioned by fitting a part of the metal structure 23 into the fitting portion 26*a* of the first base 26. In addition, the metal structure 23 can be positioned by fitting the bottom portion of the bulb 22 into the fitting portion 27*a* of the second base 27.

In addition, in the light-emitting sealed body 21, a surface of a part of the metal structure 13 is coated with the nickel film 25 to be the magnetic film made of the ferromagnetic material and the nickel film 25 and the magnet 28 buried in the second base 27 cooperate with each other, so that the metal structure 23 can be positioned by the magnetic force by the bulb 22. In this embodiment, the three configurations of the first base 26, the second base 27, and the magnet 28 are included as the positioning unit 24. However, the metal structure 23 may be positioned by any one of the first base 26, the second base 27, and the magnet 28 or a combination of the two members thereof. In addition, in the light-emitting sealed body 21, the metal structure 23 has the spherical shape. For this reason, if the metal structure 23 is rotated, a region becoming an incidence portion of the laser light L can be changed. Therefore, it is possible to correspond to the case in which lighting is deteriorated.

[Third Embodiment]

Figure 6:
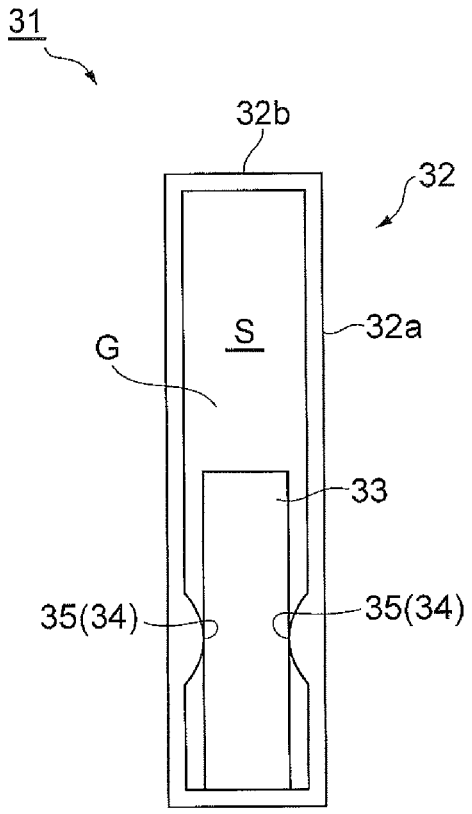
FIG. 6 is a diagram illustrating a light-emitting sealed body according to a third embodiment of the present invention.

FIG. 6 is a diagram illustrating a light-emitting sealed body according to a third embodiment of the present invention. As illustrated in the same drawing, in a light-emitting sealed body 31 according to the third embodiment, a shape of a bulb 32, a shape of a metal structure 33, and a configuration of a positioning unit 34 are different from those in the first embodiment.

More specifically, in the light-emitting sealed body 31, the bulb 32 is formed using a cylindrical portion 32*a* and a metal structure 33 disposed in an internal space S of the bulb 32 also has a cylindrical shape. An outer diameter of the metal structure 33 is slightly smaller than an inner diameter of the bulb 32 and the metal structure 33 is disposed at a base end side of the internal space S of the bulb 32. In an inner wall of a trunk portion of the bulb 32, a small diameter portion 35 protruding to a circumferential surface side of the metal structure 33 is formed as a positioning unit 34 of the metal structure 33.

Even in the light-emitting sealed body 31, the metal structure 33 and the positioning unit 34 do not penetrate the bulb 32 and parts thereof are not buried in the bulb 32 and weakened portions are not formed in the bulb 32 made of glass. For this reason, a sealing state of the bulb 32 can be maintained surely. In addition, in the light-emitting sealed body 31, it is possible to cause a laser light L to be incident from an end face 32*b* of an axial direction of the bulb 32 having the cylindrical shape. Therefore, an aberration (for example, astigmatism) of the laser light L can be suppressed as compared with the case in which the laser light L is incident on the spherical bulb. In addition, the small diameter portion 35 is used, so that the metal structure 33 can be positioned with a simple structure. Instead of the small diameter portion 35, the spacer member or the elastic member used in FIG. 2(*a*) or FIG. 2(*b*) may be used. Also, the metal structure 33 may have the configuration illustrated in FIG. 1 or FIG. 3.

[Fourth Embodiment]

Figure 7:
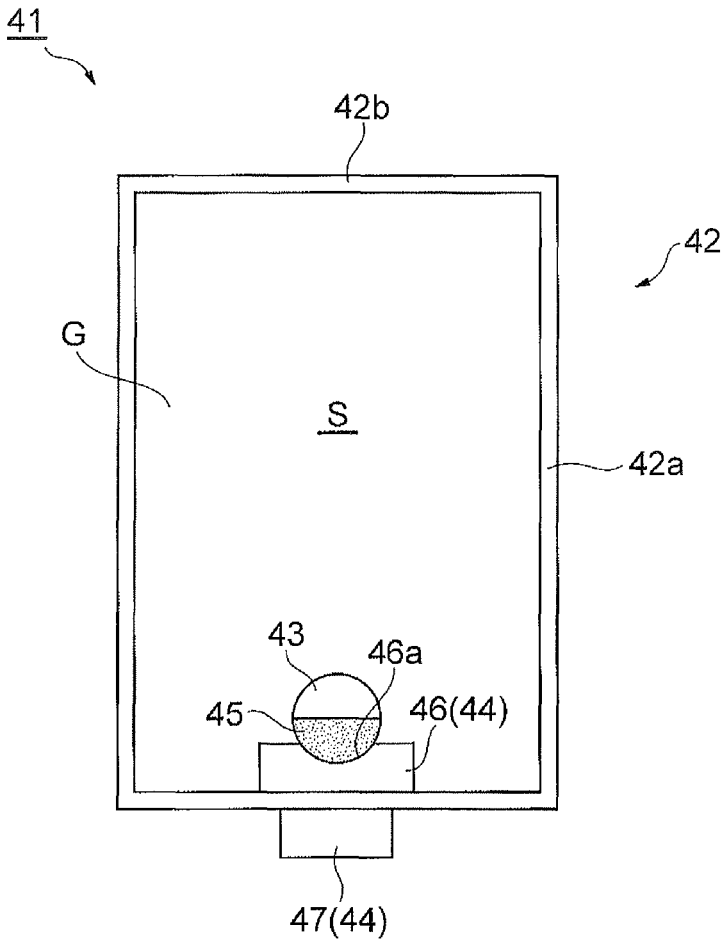
FIG. 7 is a diagram illustrating a light-emitting sealed body according to a fourth embodiment of the present invention.

FIG. 7 is a diagram illustrating a light-emitting sealed body according to a fourth embodiment of the present invention. As illustrated in the same drawing, in a light-emitting sealed body 41 according to the third embodiment, a shape of a bulb 42, a shape of a metal structure 43, and a configuration of a positioning unit 44 are different from those in the first embodiment.

More specifically, in the light-emitting sealed body 41, the bulb 42 is formed using a cylindrical portion 42*a*. Meanwhile, a metal structure 43 that is disposed in an internal space S of the bulb 42 has a spherical shape. In addition, coating is performed on a surface of the metal structure 43 using a magnetic film made of a ferromagnetic material, such as a nickel film 45, to cover nearly a half of the surface of the metal structure 43. In a bottom portion of the internal space S of the bulb 42, a first base 46 having a fitting portion 46*a* into which a part (for example, a portion coated with the nickel film 45) of the metal structure 43 is fitted is disposed as a positioning unit 44. Meanwhile, at the outside of the bulb 42, a magnet 47 functioning as the positioning unit 44 is disposed at a position facing the first base 46.

Even in the light-emitting sealed body 41, the metal structure 43 and the positioning unit 44 do not penetrate the bulb 42 and parts thereof are not buried in the bulb 42 and weakened portions are not formed in the bulb 42 made of glass. For this reason, a sealing state of the bulb 42 can be maintained surely. In addition, in the light-emitting sealed body 41, it is possible to cause a laser light L to be incident from an end face 42*b* of an axial direction of the bulb 42 having the cylindrical shape. Therefore, an aberration (for example, astigmatism) of the laser light L can be suppressed as compared with the case in which the laser light L is incident on the spherical bulb.

In addition, in the light-emitting sealed body 41, the metal structure 43 can be positioned by fitting a part of the metal structure 43 into the fitting portion 46*a* of the first base 46. In addition, in the light-emitting sealed body 41, the surface of the part of the metal structure 43 is coated with the magnetic film made of the ferromagnetic material and the magnet 47 is disposed at the outside of the bulb 42 to face the first base 46. As a result, the metal structure 43 positioned by the first base 46 can be held surely by magnetic force.

REFERENCE SIGNS LIST

11, 21, 31, 41 light-emitting sealed body; 12, 22, 32, 42 bulb (casing); 12*a* spherical portion (body portion); 12*b* protrusion portion; 13, 23, 33, 43 metal structure (electron emission structure); 13*a* electron emission unit; 13*b* support unit; 13*d* large diameter portion; 13*e* inclined surface; 14, 24, 34, 44 positioning unit; 15, 20 rod-shaped member; 16, 35 small diameter portion; 17 spacer member; 18 plate spring member (elastic member); 19 coil (magnetic force application unit); 20*a* minute diameter portion; 20*b* body portion; 20*c* relay portion; 25, 45 nickel film (magnetic film); 26, 46 first base; 26*a*, 46*a* fitting portion; 27 second base; 27*a* fitting portion; 28, 47 magnet; G light emission gas; L laser light; S internal space.

The invention claimed is:

1. A light-emitting sealed body comprising:

a casing of which an internal space is filled with light emission gas;

an electron emission structure that comprises an easily electron-emitting material emitting electrons by radiation of a laser light; and a positioning unit that positions the electron emission structure in the internal space, wherein the electron emission structure is disposed only in the internal space of the casing, the positioning unit is disposed only in the internal space of the casing or at the outside of the casing, wherein the electron emission structure has an electron emission unit that is made of a metal member comprising the easily electron-emitting material and a support unit that supports the electron emission unit, the support unit is positioned in the internal space by the positioning unit, so that the electron emission structure is positioned in the internal space, and the support unit is not buried in the casing.

2. The light-emitting sealed body according to claim 1, wherein the casing has a body portion where the electron emission unit is positioned and a protrusion portion that protrudes from the body portion, and the support unit is positioned in the protrusion portion by the positioning unit.

3. The light-emitting sealed body according to claim 2, wherein a small diameter portion obtained by reducing an inner diameter of the protrusion portion to contact the support unit is formed as the positioning unit.

4. The light-emitting sealed body according to claim 2, wherein a spacer member is provided as the positioning unit between the support unit and an inner wall of the protrusion portion and the support unit is fitted into the internal space of the protrusion portion by the spacer member.

5. The light-emitting sealed body according to claim 2, wherein an elastic member is provided as the positioning unit between the support unit and an inner wall of the protrusion portion and the support unit is fitted into the internal space of the protrusion portion by the elastic member.

6. The light-emitting sealed body according to claim 2, wherein at least a part of the support unit is formed of a metal, and a small diameter portion obtained by reducing an inner diameter of the protrusion portion, a large diameter portion provided in the support unit to contact the small diameter portion, and a magnetic force application unit applying magnetic force to the support unit from the outside of the casing such that the large diameter portion contacts the small diameter portion are formed as the positioning unit.

7. The light-emitting sealed body according to claim 2, wherein at least a part of the support unit is formed of a metal, and a spacer member provided between the support unit and an inner wall of the protrusion portion such that the support unit is inserted, a large diameter portion provided in the support unit to contact the spacer member, and a magnetic force application unit applying magnetic force to the support unit from the outside of the casing such that the large diameter portion contacts the spacer member are formed as the positioning unit.

8. The light-emitting sealed body according to claim 1, wherein the support unit is made of a rod-shaped member, and the rod-shaped member has a minute diameter portion that supports the electron emission unit and has a diameter smaller than a diameter of the body portion.

9. The light-emitting sealed body according to claim 1, wherein the support unit is made of a rod-shaped member, and the rod-shaped member has a minute diameter portion that has a diameter smaller than a diameter of the body portion and a relay portion that is supported to the minute diameter portion, is thicker than the minute diameter portion, and supports the electron emission unit.

10. The light-emitting sealed body according to claim 1 wherein the electron emission unit has an inclined surface that is inclined to an incidence axis of the laser light.

11. The light-emitting sealed body according to claim 1, wherein the electron emission structure has a spherical shape, and the positioning unit has a magnetic film that is made of a ferromagnetic material and covers at least a part of the electron emission structure and a magnet that is disposed to face the casing at the outside of the casing.

12. The light-emitting sealed body according to claim 1, wherein the electron emission structure has a spherical shape, and the positioning unit has a first seat which is disposed in the casing and into which a part of the electron emission structure is fitted.

13. The light-emitting sealed body according to claim 1, wherein both the casing and the electron emission structure have a spherical shape, and the positioning unit has a second base which is disposed at the outside of the casing and into which a part of the casing is fitted.

14. The light-emitting sealed body according to claim 1, wherein both the casing and the electron emission structure have a cylindrical shape, and a small diameter portion obtained by reducing an inner diameter of the casing to contact the electron emission structure is formed as the positioning unit.

15. A light-emitting sealed body comprising:

a casing of which an internal space is filled with light emission gas;

an electron emission structure that comprises an easily electron-emitting material emitting electrons by radiation of a laser light; and a positioning unit that positions the electron emission structure in the internal space, wherein the electron emission structure is disposed only in the internal space of the casing, and wherein the electron emittance of the easily electron-emitting material is for generating plasma from the light emission gas, the electron emission structure comprises a base comprising a high melting-point metal and the easily electron-emitting material is contained in the base, with the base and the easily electron-emitting material comprising mutually differing metals, and the positioning unit is exposed to the internal space of the casing while being positioned only in the internal space, or is exposed to exterior space of the casing while being positioned only in the exterior space.

* * * * *